US007766506B2

(12) United States Patent
Keller

(10) Patent No.: US 7,766,506 B2
(45) Date of Patent: Aug. 3, 2010

(54) LIGHT INFLUENCING ELEMENT

(75) Inventor: Katharine Keller, Lindau (DE)

(73) Assignee: Zumtobel Staff GmbH, Dornbirn (AT)

( * ) Notice: Subject to any disclaimer, the term of this patent is extended or adjusted under 35 U.S.C. 154(b) by 1292 days.

(21) Appl. No.: 10/551,464

(22) PCT Filed: Apr. 3, 2005

(86) PCT No.: PCT/EP2004/003520

§ 371 (c)(1),
(2), (4) Date: Oct. 3, 2005

(87) PCT Pub. No.: WO2004/088203

PCT Pub. Date: Oct. 14, 2004

(65) Prior Publication Data

US 2006/0216474 A1 Sep. 28, 2006

(30) Foreign Application Priority Data

Apr. 3, 2003 (DE) ..... 103 15 268

(51) Int. Cl.
*F21V 1/00* (2006.01)
*F21V 11/00* (2006.01)

(52) U.S. Cl. ..... 362/235; 362/342; 362/354; 362/223; 362/291; 362/330

(58) Field of Classification Search ..... 362/235, 362/223, 330, 342, 354, 291, 296
See application file for complete search history.

(56) References Cited

U.S. PATENT DOCUMENTS

| | | | | |
|---|---|---|---|---|
| 2,143,148 A | | 1/1939 | Guth | 240/78 |
| 3,179,797 A | | 4/1965 | Franck | 240/106 |
| 3,600,570 A | | 8/1971 | Okada | 240/78 |
| 6,139,169 A | * | 10/2000 | Caferro | 362/342 |
| 7,001,057 B2 | * | 2/2006 | Plank et al. | 362/573 |
| 7,090,379 B2 | * | 8/2006 | Targetti | 362/342 |

FOREIGN PATENT DOCUMENTS

| | | |
|---|---|---|
| DE | 10044455 A1 | 4/2002 |
| EP | 903535 A2 | 3/1999 |
| GB | 494724 | 10/1938 |
| WO | WO 99/40364 | 8/1999 |
| WO | WO 03/001611 A1 | 1/2003 |

OTHER PUBLICATIONS

German International Preliminary Report on Patentablitiy; PCT/EP2004/003520; 13 pages; International Filing Date: Feb. 4, 2004; Priority Date: Mar. 4, 2003.*
German International Preliminary Report on Patentablitiy (Translation); PCT/EP2004/003520; 13 pages; International Filing Date: Feb. 4, 2004; Priority Date: Mar. 4, 2003.*

* cited by examiner

*Primary Examiner*—Sandra L O'Shea
*Assistant Examiner*—Jessica L McMillan
(74) *Attorney, Agent, or Firm*—Fitzpatrick, Cella, Harper & Scinto

(57) ABSTRACT

In the case of a light influencing element (6) for directing the light emitted from a light source (4) to a predetermined angular region, which has a plurality of rib-like raster elements (7, 12), which have reflecting side walls and are arranged in regular structure, the raster elements (7, 12) have a height (H) of a maximum of 5 mm. Through this there arise on the one hand greater freedoms in the design of the luminaire. On the other hand, the luminaire is lent an optical appealing appearance.

27 Claims, 2 Drawing Sheets

LIGHT INFLUENCING ELEMENT

This application is a national stage application under 35 U.S.C. §371 of PCT/EP2004/003520, filed Apr. 2, 2004, which is incorporated by reference in its entirety.

BACKGROUND OF THE INVENTION

1. Field of the Invention

The present invention relates to a light influencing element for directing the light emitted from a light source in accordance with the preamble of the independent claims. In particular the invention concerns a so-called luminaire raster.

2. Description of the Related Art

Rasters are known as optical elements for luminaires and are usually employed for the purpose of concentrating or restricting light emitted from, a light source to a predetermined angular range. Through this it can be prevented that persons are dazzled by the light emitted from a luminaire. Further, disruptive reflections, in particular at vertically standing surfaces—for example at display screens—are avoided. Such rasters thus find use in particular in rooms in which work stations are located.

Luminaire rasters of above-described kind usually consist of a regular structure of raster elements with mirrored side walls, which seen in the light emission direction are arranged before the light source. For the desired optical effect of concentration of the light rays to a predetermined range a particular relationship between spacing and height of the respective raster elements must be maintained.

A typical raster of the above-described kind is for example known from U.S. Pat. No. 6,139,169. As is illustrated in this publication, the raster elements in comparison to the light sources usually have a height of a number of centimeters, as a rule about 5 cm, wherein the spacing between two raster elements is in each case somewhat larger. Through this, the possibilities for reducing the structural height of the luminaire are limited.

SUMMARY OF THE INVENTION

The present invention has the object of providing a new type of light influencing element, which makes possible a lesser structural height of luminaires. At the same time, however, the optical properties of a typical luminaire raster should be retained.

The object is achieved by means of a light influencing element which has the features of the independent claims. As for a typical luminaire raster, the light influencing element in accordance with the invention is of a plurality of rib-like raster elements, which each have reflecting side walls and are arranged in a regular structure.

In accordance with a first aspect of the present invention, the raster elements have a height of a maximum of 5 mm, preferably of 1 mm. The spacing between two raster elements corresponds preferably to about double the height of the raster elements.

Through the solution in accordance with the invention there is thus provided a luminaire raster having miniaturized raster elements, wherein however the desired light directing or light concentrating characteristics are attained. Due to the slight height of this microraster, there are greater freedoms in the configuration of luminaires. In particular, luminaires with a very slight structural height can be attained. Beyond this, the light influencing element in accordance with the invention lends the luminaires an optically appealing appearance. Further, dazzle effects are reduced even when observing the luminaire at angles in which light emission is to be effected.

In accordance with a second aspect of the present invention, the raster elements are arranged on a transparent base plate. Through this a new type of light influencing element is provided, which likewise manifests the desired light technical characteristics of a luminaire raster, but lends the luminaire a different appearance. Preferably also here the raster elements have a height of a maximum of 5 mm.

Further developments of the invention are subject of the subclaims.

The rib-like webs may, seen in cross-section, take on any shape which makes possible light directing in the desired manner. For example, there is the possibility of forming the webs—as is usual with conventional luminaire rasters—V-shaped. Alongside this, also parabolic shapes or ribbed structures are conceivable.

The raster elements are preferably of a plastic, in particular of PMMA, whereby due to their slight dimensions they represent a relatively unstable object. In order to increase the stability of the light influencing element, the raster elements may thus be held together via a side frame.

A further possibility of increasing the stability of the light influencing element consists, in accordance with a second aspect of the invention, also in arranging the raster elements on a transparent base plate. In particular, the raster elements may be formed in one piece with the base plate. Alternatively to this, there is however also the possibility of gluing the base plate with the raster elements.

On the side of the raster elements opposite to the base plate, there may be arranged a further transparent plate which not only brings with it the advantage that the stability is additionally increased, but also makes possible a more simple cleaning of the light influencing element. Beyond this, the raster is fundamentally better protected against contamination.

The raster elements may, as with the lamellas of a conventional luminaire raster, be arranged parallel neighbouring one another or in a crossing structure. This arrangement is particularly of advantage if elongate fluorescent tubes are employed as light sources. Beyond this there is, however, also the possibility of forming the raster elements ring-shaped, and to arrange the individual rings in a honeycomb pattern. This arrangement recommends itself particularly in the case of point-like light sources, such as for example incandescent lamps, or in the case of two dimensional light sources. Further, also ring-shaped light sources—here as a rule gas discharge lamps are concerned—can be employed, whereby the raster elements may then be arranged e.g. as concentric circles.

If the raster elements are of a transparent material, the side surfaces and preferably also the end surfaces away from the light source must be mirrored. This can for example be effected in that the raster elements are provided with a reflecting layer by means of a vapour deposition process. The light influencing element itself is preferably produced in an injection moulding process.

BRIEF DESCRIPTION OF THE FIGURES

Below, the invention will be described in more detail with reference to the accompanying drawings. There is shown.

DETAILED DESCRIPTION OF THE INVENTION

Figure 1:
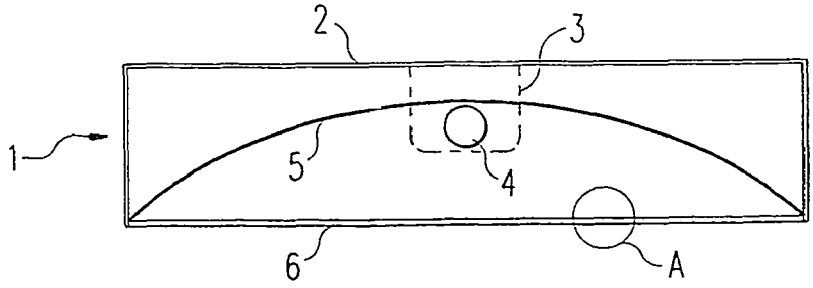
FIG. 1 a luminaire with a light influencing element in accordance with the invention, in section.

FIG. 1 shows, as an example of an application of the present invention, a recessed ceiling luminaire 1 having an elongate light source 4 with which a light influencing element 6 in accordance with the invention is put to use. Of course, however, light influencing elements in accordance with the present invention can also be put to use in the case of other luminaire types. In particular, application is not restricted to luminaires having elongate light sources.

The luminaire 1 illustrated in FIG. 1 is of a box-shaped luminaire housing 2, at the base side of which there are arranged connection means 3 for the light source 4, which is a fluorescent tube. The light emitted from the fluorescent lamp 4 is directed with the aid of a reflector 5 arranged in the housing 2 to the light exit opening of the housing 2 and emitted via this.

In order to concentrate or restrict to a predetermined angular range the light rays passing directly from the lamp 4 or via the reflector 5 to the light exit opening, a light influencing element 6 is arranged at the light exit opening, which light influencing element brings about a concentration of the light rays to the desired range. The light influencing element 6 is only a few millimeters high and thus opens up the possibility of keeping the structural height of the luminaire 1 very slight.

Figure 2:
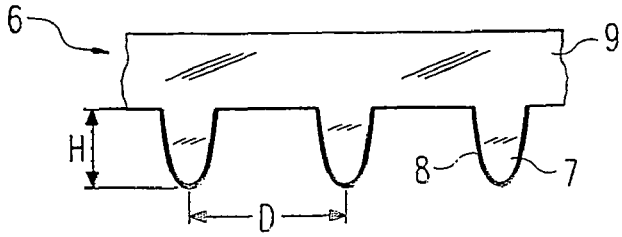
FIG. 2 an illustration to an enlarged scale of a first exemplary embodiment of a light influencing element in accordance with the invention.

FIG. 2 shows an enlarged detail A of the light influencing element 6, in section. In the case of this first exemplary embodiment, the light influencing element 6 is of a transparent base plate 9 on the lower flat side of which rib-like raster elements 7 are arranged in a regular structure. In the present example, the raster elements 7 are formed as elongate webs and arranged parallel to one another. The concentration of the light rays to the desired angular range is achieved in that the raster elements 7, likewise of a transparent material, are provided at their side surfaces and at their end surfaces with a reflecting layer 8. The light rays coming from the light source and passing through the transparent base plate 9 are thus—as in the case of a conventional luminaire raster—reflected at the side surfaces of the raster elements 7, so that a light emission is made possible only in a restricted angular range.

The height H of the raster elements 7 is a maximum of 5 mm, preferably is about 1 mm. In order to ensure the concentration of the light rays to the desired angular range the spacing D between two neighbouring raster elements 7 must likewise not be too great. Preferably the spacing D corresponds approximately to twice the height of a raster element 7.

It is even possible, with the exploitation of lithographic techniques, to further significantly reduce the height H and the spacing D of the raster elements 7 in comparison to the above indicated values, and this as far as the range from about 20 μm for the height H and correspondingly about 40 μm for the raster element spacing D. Through the slight dimensions of the raster elements 7 the structural height of the light influencing element 6 and therewith the height of the luminaire 1 overall can be significantly reduced. Despite this, the desired optical effect of light concentration is attained. The slight spacing between two neighbouring raster elements 7 has further, in comparison to conventional rasters, even at viewing angles in which light emission should occur, an additional anti-dazzling effect as a consequence. Beyond this, the appearance of the luminaire overall is positively influenced.

The raster elements 7 may—as illustrated in FIG. 2—have a slightly V-shaped form seen in cross-section, as is known from conventional luminaire rasters. However, there is also the possibility, as the exemplary embodiments in FIGS. 3*a* and *b* show, of differently configuring the raster elements 7. In the example in FIG. 3*a*, the raster elements 7 have a parabolic-shaped V-structure, whilst in FIG. 3*b* they have a particular rib structure, which is formed by means of prismatic or wedge shaped stepped sections 7*a* arranged above one another. Such rib structures are known for example from AT 308 901 or EP 0 286 890 A1.

Figure 3A:
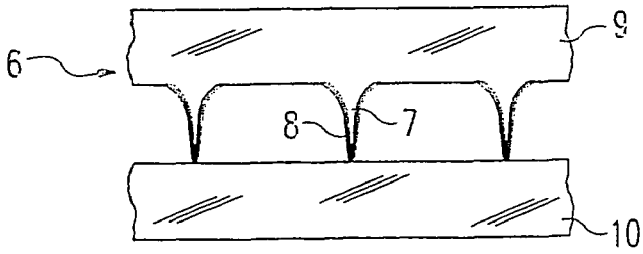
FIGS. 3*a* and*b* variants of a second exemplary embodiment of a light influencing in accordance with the invention.
Figure 3B:
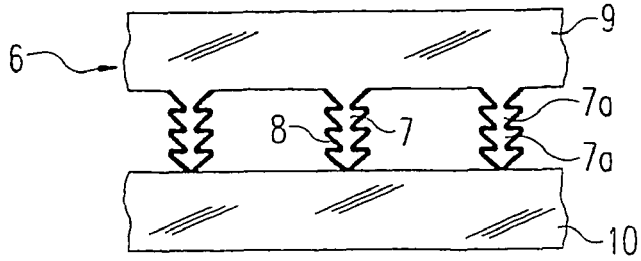

In the case of the exemplary embodiments in FIG. 2 and FIGS. 3*a, b* the raster elements 7 are in each case connected in one piece with the base plate 9 of a transparent material. This recommends itself particularly if the light influencing element 6 in accordance with the invention is of a transparent plastic and is produced in an injection moulding process. For injection moulding any kind of plastic can be employed which makes possible the formation of a transparent workpiece and is suitable for injection moulding. Preferably there is used PMMA.

After the production of the plastic piece, the side and end surfaces of the raster elements 7 must be provided with a reflecting layer 8. This is effected preferably by means of a vacuum coating process, whereby it is to be taken into account that the surfaces of the base plate 6 lying between the raster elements 7 are not also coated, but still make possible a passage of light.

The advantage of the exemplary embodiments illustrated in FIGS. 2 and 3 consists in that due to the one-piece configuration of the base plate 9 with the raster elements 7, the light influencing element 6 in accordance with the invention manifests an increased stability. In order to additionally increase this stability there may be arranged at the side of the raster elements 7 opposite the base plate 9 a further transparent plate 10, as is illustrated in FIG. 3. The employment of this additional transparent plate 10 brings the further advantage that a penetration of dirt particles into the intermediate spaces between two raster elements 7 can be avoided. Beyond this, the light influencing element 6 can overall be better cleaned.

Figure 4A:
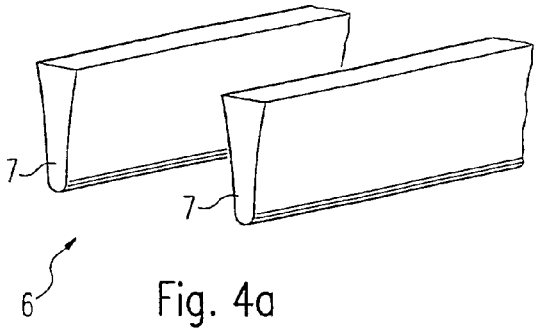
FIGS. 4*a* and*b* a third exemplary embodiment of a light influencing element in accordance with the invention, in perspective view.
Figure 4B:
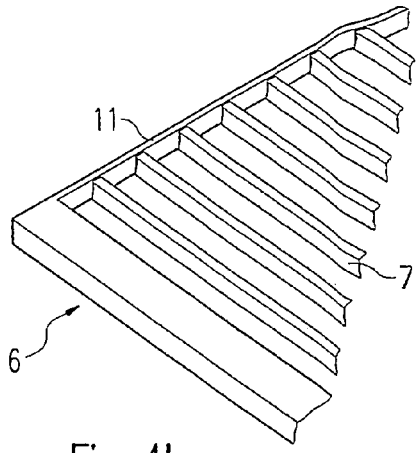

As is illustrated in FIGS. 4*a* and 4*b*, there is also the possibility of forming the light influencing element 6 in accordance with the invention without base plate. In this case, the raster elements 7 are merely arranged parallel neighbouring one another. Since, through this, there is provided a significantly lesser stability of the overall arrangement, there is provided at least one side frame 11 which holds the raster elements 7 together. Also in this case, the light influencing element 6 can be produced in an injection moulding process.

Figure 5:
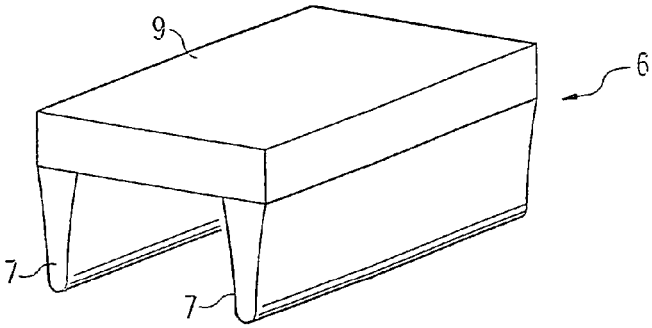
FIG. 5 a fourth exemplary embodiment of a light influencing element in accordance with the invention.

In the case of the further exemplary embodiment illustrated in FIG. 5, the raster elements 7 and the transparent base plate 9 are not formed in one piece. Instead the base plate 9 is glued with the raster elements 7 in a later step. Also through this, the stability of the light influencing element 6 is increased.

Figure 6:
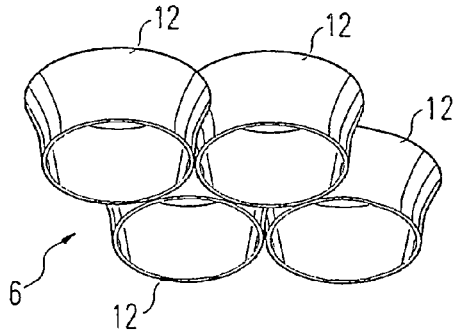
FIG. 6 a light influencing element in accordance with the invention having ring-shaped raster elements.

In the case of all so far illustrated exemplary embodiments, the raster elements were of elongate ribs which were arranged in parallel to one another. Through this, an anti-dazzle effect can be obtained for the light issued from the light source in one direction. In order to attain an anti-dazzle effect in a further direction—arranged transversely thereto—the raster elements may for example be arranged in a crossed structure. An optical effect of the same kind can also be obtained with the raster illustrated in FIG. 6. The raster elements in this case are of ring-shaped structures 12 which are arranged in a honeycomb pattern. The diameter of an individual ring structure is again preferably about 2 mm and beyond this can also be significantly less.

The employment of ring-shaped structures recommends itself in particular if a point-form light source—for example an incandescent lamp—is employed and the light influencing element has a quadratic or circular shape. In order to attain the desired light bundling, at least the inner sides of the ring structures 12 are again provided with a reflecting layer. An alternative configuration to this, which recommends itself in particular in the case of ring-shaped light sources such as for example correspondingly shaped gas discharge lamps, can also consist in forming the raster elements as concentrically arranged rings. Also in the case of these exemplary embodiments, the light influencing elements 6 can be produced with a very slight structural height.

Figure 7:
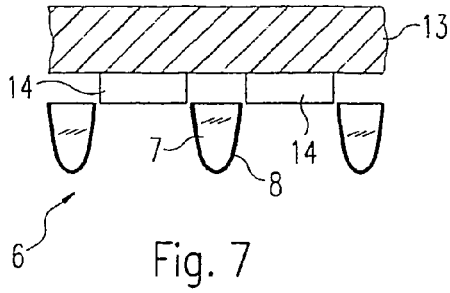
FIG. 7 the cooperation of the light influencing element in accordance with the invention with a particularly configured two dimensional illumination means.

Alongside this, also two dimensional illumination means can be employed, whereby each of the illustrated exemplary embodiments can be employed as light influencing element. A particular combination between a two dimensional illumination means, which is known for example from WO 99/40364 A1 of the present applicant, and a light influencing element in accordance with the invention, is illustrated in FIG. 7. Here the illumination means is of a base plate 13 on the side surface of which towards the raster elements 7, individual light sources 14 are arranged. These light sources 14, which are for example of an organic material, or an inorganic semiconductor material, which upon application of an electrical voltage emit light, have very slight dimensions and thus can be arranged with respect to the light influencing element 6 such that they emit their light practical exclusively into the free spaces between the raster elements 7. The efficiency of the luminaire formed in this manner is optimized, since the light sources 14 cover solely the intermediate space between two raster elements 7. Of course, other two dimensional illumination means can be employed, whereby again for optimisation of the efficiency, the upper sides of the raster elements 7 are preferably associated with regions of the illumination means which do not emit light. The exemplary embodiment illustrated here makes possible the realization of a particularly flat luminaire, since along with the light influencing element also the light source has a very slight height.

The present invention thus opens up the possibility of achieving a light bundling of the light emitted from a light source with an optical element that has a very slight height. Through this there arise on the one hand greater freedoms in the design of a luminaire. On the other hand, the luminaire is lent an optically appealing appearance, whereby despite this, the desired light technical characteristics are obtained.

The invention claimed is:

1. A light influencing element for directing light issued from a light source into a predetermined angular range, the light influencing element comprising:

a plurality of rib-like raster elements which have reflecting side walls and are arranged in a regular structure; and a transparent base plate having a broad side on which the raster elements are arranged, the raster elements being secured to the base plate.

2. The light influencing element according to claim 1, wherein the raster elements are held together via a side frame.

3. The light influencing element according to claim 1, the raster elements being arranged on a broad surface formed on the broad side.

4. The light influencing element according to claim 3, wherein the base plate and the raster elements are formed in one piece.

5. The light influencing element according to claim 3, wherein the base plate is glued to the raster elements.

6. The light influencing element according to claim 3, wherein on the side of the raster elements opposite to the base plate there is arranged a further transparent plate.

7. The light influencing element according to claim 1, wherein the raster elements are of a transparent material, and wherein at least the side walls and end surfaces of the raster elements away from the light source are provided with a reflecting layer.

8. The light influencing element according to claim 1, wherein the element is injection moulded.

9. The light influencing element according to claim 1, wherein the raster elements are of PMMA.

10. The light influencing element according to claim 1, wherein a spacing between two raster elements equals about double the height of the raster elements.

11. The light influencing element according to claim 10, wherein the raster elements have a height of about 1 mm and the spacing is about 2 mm.

12. The light influencing element according to claim 1, wherein the raster elements are linearly formed and arranged parallel neighbouring one another.

13. The light influencing element according to claim 1, wherein the raster elements are linearly formed and arranged in a crossing structure.

14. The light influencing element according to claim 1, wherein the raster elements are ring-shaped.

15. The light influencing element according to claim 14, wherein the ring-shaped raster elements are arranged in a honeycomb pattern.

16. The light influencing element according to claim 15, wherein the ring shape has a diameter of about 2 mm.

17. The light influencing element according to claim 15, wherein the ring-shaped raster elements are concentrically arranged.

18. The light influencing element according to claim 1, wherein the raster elements have a V-shaped cross-section.

19. The light influencing element according to claim 1, wherein the raster elements have a parabolic cross-section.

20. The light influencing element according to claim 1, wherein the raster elements each have a ribbed cross-section.

21. The light influencing element according to claim 20, wherein the ribbed cross-section of the raster elements is formed by means of prismatic or wedge-shaped stepped sections arranged over one another.

22. A luminaire comprising:

a light source for issuing light; and a light influencing element for directing light issued from the light source into a predetermined angular range, wherein the light influencing element has a plurality of rib-like raster elements which have reflecting side walls and are arranged in a regular structure, and further has a transparent base plate having a broad side on which the raster elements are arranged, the raster elements being secured to the base plate.

23. The luminaire according to claim 22, wherein the light source is two-dimensional.

24. The luminaire according to claim 22, further comprising an illuminating base plate having individual light sources arranged on a side surface of the base plate towards the raster element.

25. The luminaire according to claim 22, wherein the individual light sources are so arranged, with regard to the light influencing element, that they emit their light substantially into the free spaces between the raster elements.

26. A raster arrangement having a plurality of raster elements arranged neighbouring one another, having reflecting side walls for effecting an anti-dazzling effect of the light emitted from a light source, wherein the raster elements are formed by profile lamella elements produced by solid material injection molding each of which is held at two ends by a frame part, and wherein the raster elements have a maximum height of 5 mm.

27. A light influencing element for directing light issued from a light source into a predetermined angular range, wherein the light influencing element has a plurality of rib-like raster elements which have reflecting side walls and are arranged in a regular structure, and wherein the raster elements have a maximum height of 5 mm, wherein the raster elements are of a transparent material, and wherein at least the side walls and the end surfaces of the raster elements away from the light source are provided with a reflecting layer.

* * * * *